US005469659A

United States Patent [19]

Reid et al.

[11] Patent Number: 5,469,659

[45] Date of Patent: Nov. 28, 1995

[54] PET DOOR

[75] Inventors: Alister P. Reid, London; John Kopec, Accrington; Christopher Sumner, St. Helens, all of England

[73] Assignee: Reilor Limited, England

[21] Appl. No.: 163,664

[22] Filed: Dec. 7, 1993

[30] Foreign Application Priority Data

Dec. 11, 1992 [GB] United Kingdom ..... 9225879

[51] Int. Cl.[6] ..... E05D 15/48

[52] U.S. Cl. ..... 49/169; 160/180; 292/251.5

[58] Field of Search ..... 160/180, 116, 160/368.1, 90, 2, 8; 49/163, 169, 171; 292/251.5

[56] References Cited

U.S. PATENT DOCUMENTS

| | | | |
|---|---|---|---|
| 4,022,263 | 5/1977 | Beckett et al. | 160/180 X |
| 4,216,743 | 8/1980 | Cohen | 49/171 X |
| 4,969,292 | 11/1990 | Reid et al. | 49/169 |
| 4,991,350 | 2/1991 | Kirk | 49/169 |

FOREIGN PATENT DOCUMENTS

| | | | |
|---|---|---|---|
| 963444 | 7/1964 | United Kingdom . | |
| 1567001 | 5/1980 | United Kingdom | 49/169 |
| 2141479 | 12/1984 | United Kingdom . | |
| 2236135 | 3/1991 | United Kingdom | 49/169 |

*Primary Examiner*—Peter M. Cuomo
*Assistant Examiner*—Jerry Redman
*Attorney, Agent, or Firm*—Dority & Manning

[57] ABSTRACT

A pet door has a frame defining an access aperture and a pivotally-hung aperture-closing flap therein with a catch to secure the flap against opening in one direction. The catch is supported on a toggle joint spring-biased against one of two adjacent abutments. The second abutment, which is displaceable, is normally positioned to prevent collapse of the toggle joint whereby the catch is maintained in a flap-securing position. The second abutment is part of a magnetically-activated catch control mechanism, comprising (i) a rotationally mounted disc or lever bearing the abutment and (ii) a rockable lever interconnected with the disc. The rockable lever bears magnet(s) co-operable with a key magnet on a pet collar. When the key magnet is presented to the pet door, it repels the magnet(s) on the rockable lever causing the interconnected disc to rotate, displacing the second abutment. A thrust in said one direction on the flap, pressing on the catch, effects collapse of the toggle joint, disengaging the catch from the flap and thus allowing the latter to open.

20 Claims, 3 Drawing Sheets

PET DOOR

BACKGROUND OF THE INVENTION

The present invention relates to an improved pet door.

A typical, basic pet door comprises a frame defining an opening or portal and a pivoted closure flap, usually top-hung in the opening. Such a pet door when mounted in a door, window or external wall allows a pet to enter or exit a building at will, by pushing aside the flap. Regrettably unwanted animals can also enter the building through such a pet door.

Some commercial pet doors have a flap locking device which enables the pet owner to control the freedom of a pet to pass through the pet door. See, for example, our GB patent No. 2 142 070. Such a device may be set to allow passage in and out, to allow passage in one chosen direction, e.g. in only, and to bar passage in and out. "In" and "out" mean into and out of the building. Unwanted animals are not prevented from entering a building when the flap locking device is set to allow passage into, or both into and out of, the building.

To guard against unwanted animals, e.g. stray cats, entering a building, so-called selective pet doors have been developed. Selective pet doors have a latch which secures the flap against opening in at least the in direction, and means to retract the latch freeing the flap when the owner's pet approaches the pet door.

One such pet door, our Staywell (RTM) No. 21 pet door, embodies a sophisticated electronic circuit to control a solenoid for retracting the latch itself. The circuit is activated when the pet, wearing a collar bearing a passive inductive key element to which the circuit is tuned, closely approaches the pet door. The circuit can be tuned to respond to a large number of different inductances, or key "differs". Thus, even though there may be a substantial number of these pet doors in a neighbourhood, and hence a substantial number of pets wearing keyed collars, only each owner's pet can enter its building. This system is disclosed in our GB patent No. 2 119 431.

Another pet door, which will only allow passage of a pet wearing a key collar, is magnetically-activated. The key element is a magnet. When it is brought into close vicinity of the pet door, the key activates a magnetic reed switch to close an electric circuit which energises a solenoid, the latter then serving to retract the latch and free the flap. This, selective pet door can only distinguish between a pet bearing a key magnet from an animal bearing no such key magnet. This system is disclosed in GB patent No. 1 588 673.

Selective pet doors such as outlined are relatively costly. Another drawback is that they need a source of electrical energy. If mains electricity is used, there are the costs and complications of transforming the supply and of installation. If battery power is used, batteries will require replacing at more or less frequent intervals. Thus, the above selective pet doors may not be ideal for everybody.

SUMMARY OF THE INVENTION

A desirable pet door would reliably discern between animals to be admitted and animals to be barred and react accordingly, while requiring no form of electrical energy to function.

A latchable pet door has been proposed comprising a magnetic cum mechanical latch contrivance which reacts to a pet bearing a key collar, the key of which is a small magnet. The latch comprises a simple, pivoted lever resembling a see-saw. At one end there is a catch normally engageable with the flap, to prevent it being opened in one direction. At the other end the lever mounts a magnet. The weight of the magnet ensures the catch is in a position to engage the flap. The catch is to be retracted away from the flap, releasing the latter, when a cat bearing a collar key magnet attempts to pass through the door. The key magnet attracts the lever magnet and should thereby displace the lever about its pivot, retracting the catch from the flap. This arrangement is disclosed in GB patent NO. 1 567 001.

Simple though the principle of this see-saw latch arrangement is, we have found it virtually impossible in practice to make it work reliably and to manufacture it economically. Moreover, we suspect that small cats and kittens may be disconcerted by the magnetic attraction between the key and lever magnets.

One problem lies in the relatively low force of attraction between the magnets, which inter alia means that the flap may not be released should the pet not position itself centrally of the pet door. Weak magnets have other adverse consequences. For instance, the pet's nose may contact and push against the flap before the catch has been retracted therefrom. The flap can then be pressed against the catch with sufficient force as to prevent the weak magnetic attraction from being able to rock the see-saw lever to the flap-released position. One might endeavour to increase the length of the see-saw lever, to place its magnet further from the flap. The objective would be to ensure the pet's nose cannot press upon the flap before the magnetic attraction has rocked the lever to the flap-released position. Unfortunately, because practical magnets are weak and the range of effective attraction is minimal, by the time the pet has moved into a flap-contacting position and the collar magnet has passed the see-saw magnet, the remaining attractive force would be insufficient to retain the lever in the flap-released position. The flap would thus not remain released for opening.

In the proposed see-saw arrangement, the weight of the lever magnet is utilised to bias the lever to a flap-latching position. We have found that this is responsible for another difficulty. Should the latch arrangement function properly and allow a pet to pass through the door, the flap will ultimately swing back towards its closing position and strike the catch. It should momentarily displace the catch and move past it before coming to rest engaged with and latched by the catch. In practice, it is not easy to ensure this will always happen. Frequently, we find that the catch is not displaced at all by the flap. Instead, the catch arrests the swinging flap which then adopts a non-latched position. Thus, the latch fails to reset properly.

The foregoing problems have emerged in the course of our efforts to put the see-saw latch arrangement into practice.

Conceivably, the magnets might be made larger and stronger. If this were done, there would be cost penalties and a small domestic pet such as a kitten might not tolerate the extra weight.

Stronger magnets for a given weight than obtainable using conventional ferrous based materials are available commercially. Conceivably, they could be employed, but their cost penalty is prohibitive.

A strong collar magnet, could well be disconcerting to a pet if it attached itself to steel articles against which the pet might brush.

The principle object of the invention is to provide a pet door with a magnetic/mechanical latch mechanism which does not require any electric supply, and which overcomes the problems outlined above.

After much experiment, we have found it possible to develop a latch arrangement which utilizes simple magnetic means to permit reliable releasing of the pet door latch.

Whilst our arrangement has a magnet-bearing see-saw lever, it is not employed as the catch per se. Rather, it is used to control a separate latch. Normally, the lever retains the latch in a flap-securing position. When, however, a collar magnet interacts with the lever magnet, the lever indirectly frees the latch enabling it to be displaced to a flap-releasing position. Strong magnets are not needed, and range-related problems are reduced significantly in part because our see-saw lever is finely balanced and is substantially frictionlessly pivoted for rocking movement. Moreover, by using a particular form of latch described hereafter, the latch-resetting problem mentioned earlier is overcome.

In the prior proposed see-saw arrangement, pressure of a pet's nose against the flap would, as we found, prevent the catch from releasing the flap. The latch employed in the present invention ordinarily retracts from the flap when a pet wearing a collar magnet pushes against the flap. The latch itself is preferably closely similar to the arrangement disclosed in our GB patent No. 2 141 479, the contents of which are incorporated herein by this reference.

According to the present invention, there is provided a pet door with a frame defining an access aperture and an aperture-closing flap pivotally mounted therein, wherein the door has latch means to bar the flap from opening in at least one direction and control means for disabling the latch means to permit the flap to open in the said direction, the latch means comprising a catch and a collapsible support normally arranged to maintain the catch in a flap-barring position, and the control means including magnetically-responsive actuating means operable, when a magnetic key means is operatively Juxtaposed with the pet door, to allow the support to collapse and enable the catch to be moved from the flap-barring position to permit the flap to open in the said direction. The key means can comprise a simple bar magnet attached to a pet collar.

Further features of the invention are defined in the claims hereafter appended to claim 1, and in the following description.

BRIEF DESCRIPTION OF THE DRAWINGS

The invention will now be described in more detail, by way of example only, with reference to the accompanying drawings, in which.

DESCRIPTION OF THE PREFERRED EMBODIMENT

Pet doors embodying this invention can allow animals ready egress from the building, but bar entry to unwanted animals such as strays, neighbours' pets and so on. Animals permitted entry are furnished with a collar bearing a key magnet. When the key magnet is appropriately juxtaposed with the pet door, it actuates a latch control means enabling the animal to disengage the latch from the pet door flap when pushing the flap aside to enter the building. The latch could, if desired, be designed to hold the flap against opening both inwards and outwards.

Figure 1:
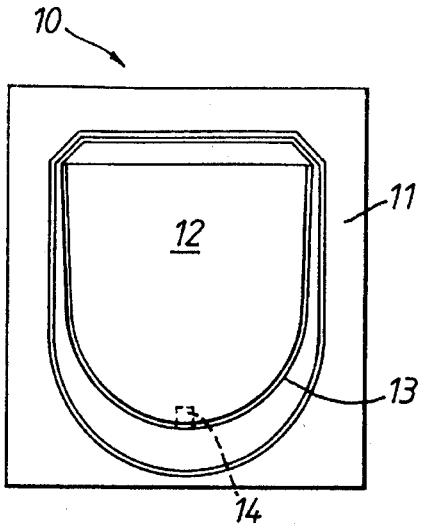
FIG. 1 is an elevation of a pet door embodying the invention.
Figure 2:
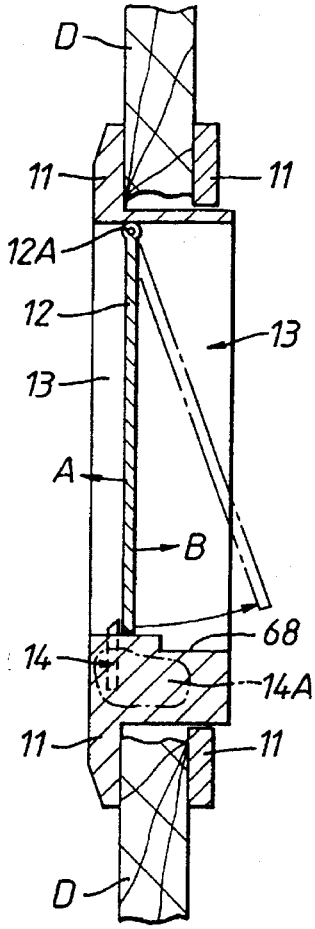
FIG. 2 is a longitudinal cross section through the pet door, shown fitted to a building door.

Referring now to the drawings, a pet door 10 embodying the present invention comprises a door frame 11 and a top-hung door flap 12 capable of swinging within the door opening 13. The door flap 12 can be swung in either direction about its top hinge axis 12A to allow a pet to pass through the door opening. However, a latch mechanism 14 normally prevents movement of the flap in one direction, A in FIG. 2. When installed e.g. in a door D of a building, direction A will usually be the inward opening direction. Although inward opening is normally barred, the latch mechanism 10 in the illustrated embodiment does not hinder opening in the opposite direction B, so pets will have ready egress from the building. As will be described, the latch mechanism 14 can be controlled to enable a pet to push the door flap 12 from engagement with the mechanism 14 and enter the building.

The latch mechanism 14 is contained in a housing 14A in the base of the frame 11. The mechanism itself comprises three principal components. They are: a movable catch 15, a support rocker or cradle 16 and a collapsible support strut 17. This mechanism is disclosed in GB 2 141 479.

The catch 15 comprises an arm 20 having an upstanding projection 21 at one end normally projecting through an aperture of the housing 14A to engage an edge (for instance the bottom edge) of the flap 12 and prevent inward opening movement in direction A. The upstanding projection 21 has a top or ramp surface 22 inclined to its door-engaging face, for a reason to be explained hereafter. Beneath the upstanding projection 21 is a recess 24 in the arm 20; this is to receive the head 25 of the collapsible strut 17. In the normal, latching condition of the mechanism 14, the strut 17 holds the arm 20 in a position such that projection 21 of the catch 15 is raised to prevent opening movement of the flap 12 in direction A. At the opposite end of the arm 20 is recess 26, which is a cylindrical hollow having an inwardly-tapering entrance. Recess 24 has a similar form. Recess 26 permits the catch 15 to form a snap fit with a pivot pin portion of the cradle 16. Intermediate the recesses 24, 26 is means to receive and retain a biasing spring 18, shown as a comparatively shallow recess.

The cradle 16 has two spaced-apart legs 28 interconnected at one end of the cradle by the pivot pin portion 29. The catch 15 is received between the legs 28, with its recess 26 pivotally engaged on pin portion 29. Oppositely-directed, aligned stub shafts 30 are provided on the legs 28, adjacent their free ends remote from pivot pin portion 29. The stub shafts 30 engage in journals (not shown) suitably provided in the door frame 11. The cradle is therefore mounted to rock about an axis through the stub shafts 30, this axis being parallel to the pin portion 29 on which the catch 15 pivots in the cradle. The stub shaft axis is closely adjacent the recess 24 seating the head 25 of the strut 17.

The collapsible strut 17 is a toggle linkage. As is conventional therefore, the toggle strut 17 has two links 17', 17" pivotally-interconnected at axis 32. One link 17' terminates in the head 25 which seats in the recess 24 of the catch 15. The other link 17" is apertured at 33 for pivotal mounting to the door frame 11. The pivot axes at 32, 33 are mutually parallel. A tension spring 35 extends between an attachment point on link 17" and a fixed anchorage in the frame 11. The spring 35 biases the toggle strut 17 toward a fixed abutment 36 on the door frame 11.

A second, displaceable abutment 60 is provided by this invention, and is part of the latch control means.

Figure 5:
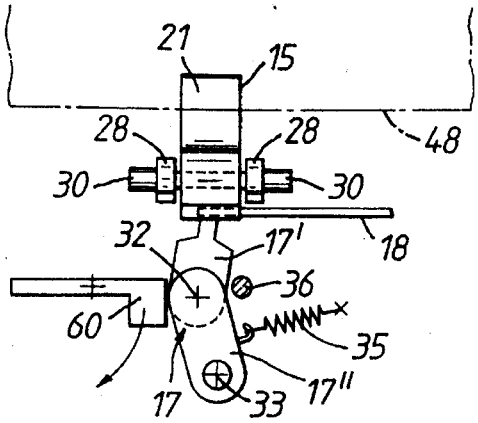
FIG. 5 shows the mechanism, as seen from the front, in a latching position.

The abutment 60 is normally disposed adjacent the interconnection between the links 17', 17", as shown in FIG. 5. It is displaceable from this position, however, when a key magnet is operatively disposed at the pet door. In its normal, FIG. 5 position, abutment 60—together with abutment 36—prevents collapse of the strut 17. In this condition, the strut positively bars downward displacement of the catch 15 about the pivot pin portion 29 and consequential disengagement of upstanding portion 21 from the door flap edge. The strut 17 can be freed so as to collapse away from the abutment 36 and allow the latch mechanism 10 to yield to an inward opening force exerted on the door flap 12, by displacement of abutment 60 to the position shown in FIG. 7. Such displacement occurs when the key magnet is presented to the pet door.

The biasing spring 18 acts between the door frame, and the assembled catch 15 and cradle 16. It engages these assembled components 15, 16 at a location remote from the pivot axis through the stub shafts 30. The spring urges the pivot pin end of the cradle 16 upwardly about the said pivot axis, while affording the cradle an ability to pivot downwardly on its stub shafts 30. Yielding of the spring occurs when the door flap 12 is returning to its closed, FIGS. 3 and 5 position after the latch and flap have disengaged and the latter has been opened inwardly. The biasing spring could be a leaf spring or a compression spring, but in the preferred embodiment is a spring wire in the shape of a hairpin.

The latch control means will now be described with particular reference to FIG. 10. When activated (by a key magnet) the control means allows the strut 17 to be collapsed when pressure on door flap 12 is exerted in direction A. Such pressure is communicated to the upstanding latch portion 21 and has the effect of displacing it downwardly with accompanying collapse of the strut 17. In the result, portion 21 is displaced into the housing 14A momentarily, allowing the flap 14 to open in direction A.

Figure 10:
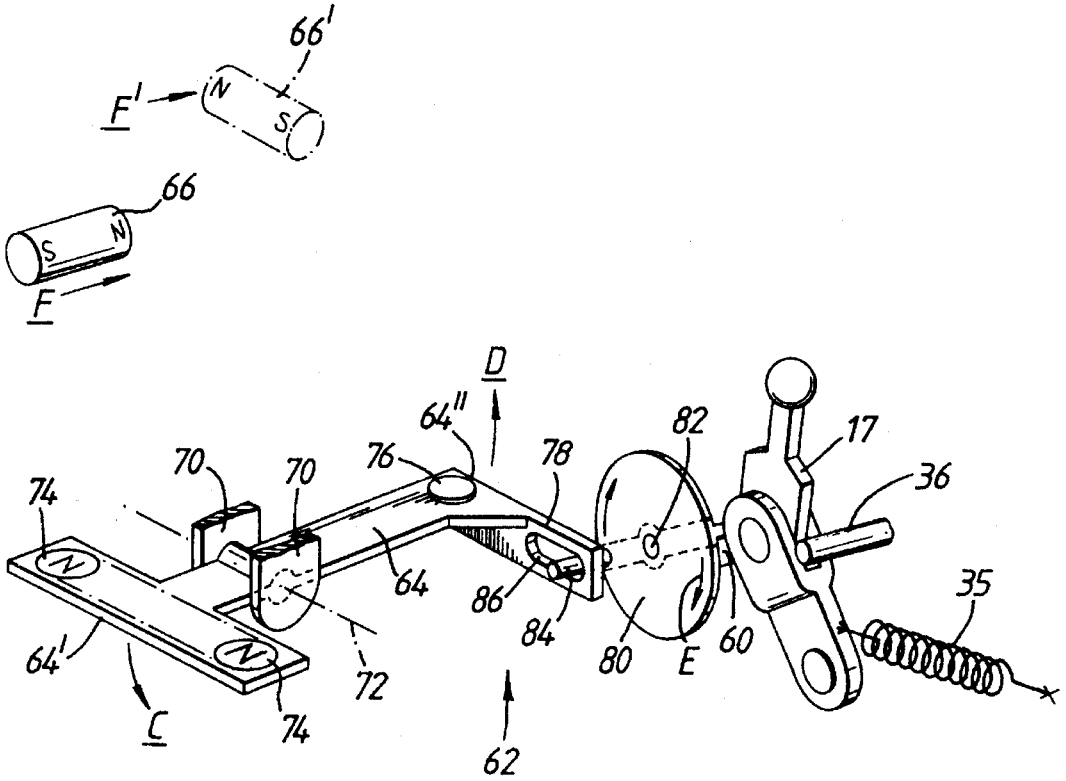
FIG. 10 illustrates a control means for the latch mechanism.

The control means 62 comprises the displaceable abutment 60 and a rocking lever (or "see-saw" lever) 64 bearing one or more magnets to coact with the key magnet, 66 in FIG. 10. Lever 64 is located inside housing 14A, beneath a sill 68 of the pet door. It is mounted intermediate its ends on a low friction pivot between lugs 70 depending from the top of the housing 14A. The pivot axis 72 is horizontally disposed. At one end 64' the lever carries the magnet(s) 74. At the other end 64" the lever carries a counter-balancing weight 76. At this end, also, the lever 64 includes a crank 78 operatively interconnected with the displaceable abutment 60. The lever 64 is finely balanced so that it normally disposes the magnets closely beneath the sill 68 and the abutment 60 in position adjacent the fixed abutment 36 to prevent collapse of the strut 17.

Recognizing that a small pet such as a kitten might not approach the pet door centrally, the lever is T-shaped, viewed in plan. It bears two, similarly-poled magnets 74. More preferably, it bears a single elongated magnet, as indicated in dotted lines in FIG. 10. The lever could be a simple straight beam bearing a single magnet, however, but would then be more sensitive to the positioning of the key magnet 66.

In the illustrated embodiment, the displaceable abutment 60 is a blade projecting from one face of a disc 80 mounted to the door frame 11 via a low-friction rotational mounting 82. A pin 84 fast with and projecting from the disc 80 is loosely received in a slot 86 in the lever crank 78. The disc lies in a plane spaced from the strut 17, to avoid the disc itself interfering with the strut.

The disc 80 could be replaced, if desired, by a simple pivoted lever as indicated in dotted lines in FIG. 10.

The constituent parts of the control means 62 are so arranged and balanced that the displaceable abutment 60 is preferably just out of contact with the strut 17 when no key magnet 66 is presented to the pet door.

Figure 6:
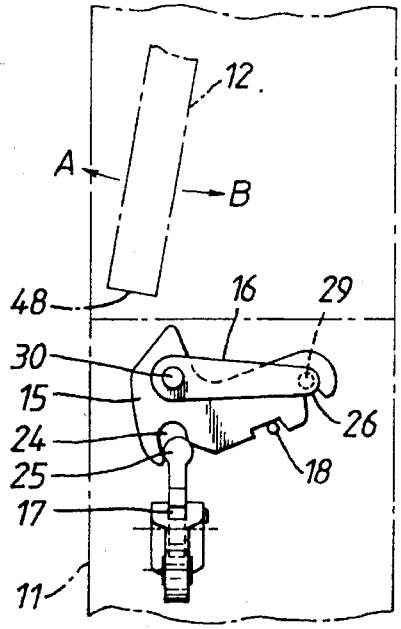
FIG. 6 shows the mechanism, as seen from the side, in a door-releasing position.
Figure 7:
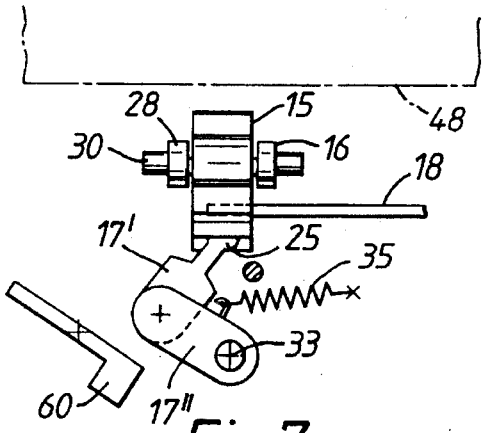
FIG. 7 shows the mechanism in the door-releasing position, as seen from the front.

An appropriate key magnet 66 is of such polarity as to repel the magnet(s) 74 when it is presented to the pet door, e.g. is brought adjacent or into the confines of the door opening 13. When this repulsion occurs, and is of such a force as to exceed the small counterbalancing effect of weight 76, and frictional resistances, end 64' of lever 64 moves downwards (arrow C) and opposite end 64" moves upwards (arrow D). Thanks to the pin and slot connection 84, 86 between the crank 78 and the disc 80, the latter is rotated about its pivot mounting 82. The abutment blade 60 is thereby displaced (in the direction of arrow E) away from its normal operative juxtaposition with the strut 17. While the abutment 60 is so displaced, the strut 17 can be collapsed as a result of force exerted on latch portion 21 by a pet pushing on the flap. FIGS. 6 and 7 show the latch mechanism in its condition corresponding to release of the flap for inward opening.

By careful attention to design and engineering, only weak repulsive forces, or weak magnets, suffice to activate the control means to allow the latch mechanism to assume the release condition.

When the key magnet 66 is moved away from the see-saw magnet(s) 74, (as by the pet passing through the pet door) ultimately the magnetic repulsion force no longer exceeds the counter-balancing force provided by weight 76. The weight can then cause the lever 64 to pivot back to its previous or normal position. End 64" and the crank 78 will swing down, rotating the disc 80 counter to direction E and returning the abutment 60 to its normal position in which it blocks collapse of the strut 17.

Figure 3:
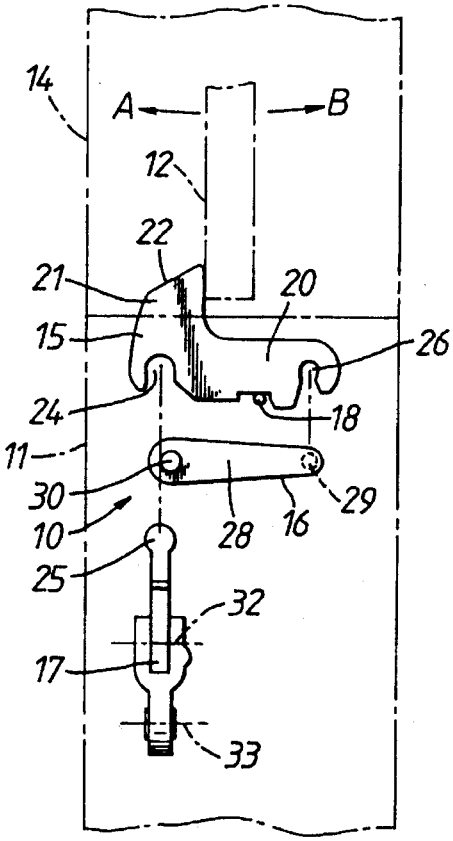
FIG. 3 schematically illustrates part of a pet door fitted with a latch mechanism according to this invention, the mechanism being shown from one side in exploded illustration.
Figure 4:
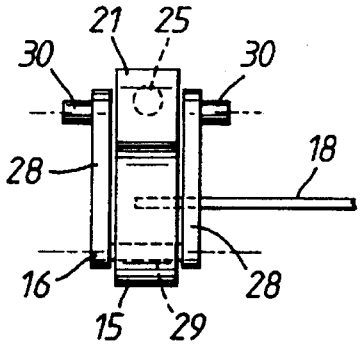
FIG. 4 illustrates the mechanism per se as seen from above.
Figure 9:
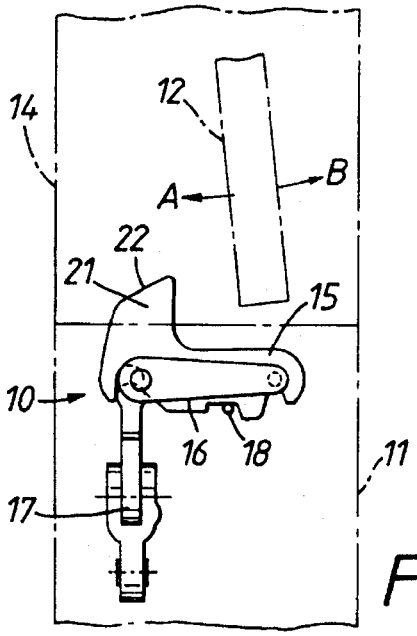
FIG. 9 shows the mechanism from the side, in its latching position to prevent inward movement of the pet door flap.

It will be observed from FIGS. 3 and 9 that an animal may push the door flap 12 open from inside the building (in direction B) without difficulty. The catch 15 does not hinder such outward opening because the door flap 12 swings away from upstanding portion 21. This portion 21 blocks inward opening movement of the flap 12 (in direction A), however, should an unwanted animal endeavour to enter the building. The flap 12 cannot over-ride the catch 15 by any force, within practical limits, exerted thereon. This is because the strut 17, being biased against the abutment 36, holds the catch in its normally raised position. The underneath support the strut 17 gives the catch is applied thereto at a point spaced from the pivot pin portion 29. Thus, the catch 15 is rendered incapable of swinging downwards by pivoting on the said portion 29. It is mechanically impossible for force exerted in direction A on the flap to pivot the assembled catch 15 and cradle 16 about the axis of shafts 30 so as to release the flap for inward opening movement.

Suppose now that a key-bearing animal wishing to enter the building approaches the door. The presence of the key will deflect or repel the see-saw lever 64 thereby displacing the abutment 60 away from the strut 17. The pet, pushing on the flap 12, is able to cause the flap to over-ride the catch thanks to the strut 17 now being freed to collapse, as described above. As the strut 17 is collapsed, spring 35 is stretched, as will be appreciated. Once the flap slips clear of the displaced catch, the spring 35 will relax and erect the collapsed strut 17, biasing it against the fixed abutment 36. The catch will be returned to its normal, raised position at the same time, i.e. is reset. As the pet moves through the door 10, moving the key magnet away from the vicinity of the lever magnet(s) 74, the abutment 60 will return to its original position as described earlier.

Figure 8:
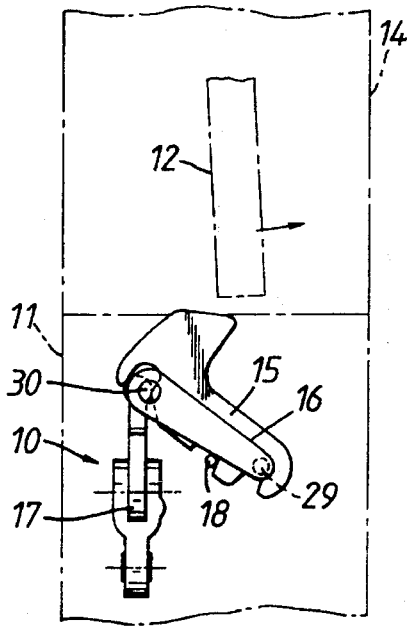
FIG. 8 shows the mechanism from the side, momentarily deflected by the moving pet door flap for resetting.

Suppose now that an animal entering the building has just cleared the door. The flap 12 then swings back in direction B towards its closed position of its own accord. As it swings, the flap edge 48 encounters the upstanding portion 21 of the raised catch 15. For the latch mechanism to lock the flap once more against entry of unwanted animals, the flap must pass the catch 15 to assume the catch-engaging position shown in FIGS. 3 and 9. To make this possible, the catch is designed to be cammed downwardly away from the moving flap edge. The camming action results from coaction of the ramped surface 22 with the moving flap 12, and rocking of the cradle 16. The catch is downwardly displaceable due to the camming action despite the strut 17 being erect and braced against the abutment 36. FIG. 8 shows the manner is which the catch is displaceable.

As shown, the strut 17 prevents displacement of catch 15 about pivot pin portion 29. Instead, the catch 15 is momentarily displaced Jointly with the cradle 16 by the flap. The assembled catch and cradle rock downwardly thanks to the pivotal attachment of the cradle 16 to the door frame through its stub shafts 30. This displacement is against the bias of spring 18. Once the flap (swinging in direction B) has encountered, displaced and passed the catch 15, the spring 18 will thrust the catch and cradle assembly upwardly about the stub shaft axis. The catch 15 is thereby raised and returned once again to its normal position, when it will prevent inward opening of the flap until such time as key magnet 66 is brought into operative juxtaposition with the lever magnet(s) 74.

The latch mechanism 10 described above has a very positive action. Before the key magnet 66 repels lever magnet(s) 74, the flap 12 is entirely secure against inward opening, no force exerted thereon being effective to override the catch 15. No significant force is needed however to displace the flap past the catch when the key magnet 66 is operatively placed at the door. Should a key-bearing animal approach the door, decide against entering the building and then move away from the door, the latch mechanism will remain active in barring inward opening of the flap.

In principle, the catch 15 could possess two upstanding portions suitably spaced apart to receive the flap therebetween. With such an arrangement, the latch mechanism 10 could lock the door against opening in either direction in the absence of the key magnet.

The force needed for displacing the abutment 60 is extremely small. The abutment and disc may together only weigh some 1.5 g and it is easy to make the rotational bearing 82 virtually frictionless. Thanks also to the fine balancing of lever 64 and its substantially frictionless pivot mounting, even weak repulsive magnetic forces between the key magnet and the lever magnet(s) will suffice to displace the abutment (60) from its FIG. 5 to its FIG. 7 position. This means that the magnets 66, 74 need not be made strong, large or of costly materials, and adequate range is obtainable from readily available magnets.

As shown in FIG. 10, magnet 74 is so poled that the upper face thereof is a north pole. The unseen lower face(s) will, of course, be south pole(s). The key magnet 66 is so mounted on a pet collar that, as the pet approaches the door, its north pole is leading (arrow F) so as to repel the magnet(s) 74 and thereby rock the lever 64. By reversing the polarity of the magnets 66, 74, a very modest degree of selectivity could be obtained. That is, two "key differs" are available. Conceivably, two further differs might be obtained. Thus, for instance, if the lever 64 carries two magnets 74, the upwardly facing poles thereof could differ (one north and the other south). A key magnet disposed as indicated in dotted lines at 66' could effect the required repulsion of the lever magnets if moved towards the door 10 in direction F'. The effective range may not be as good with such an arrangement, however, and it would be more prone to non-release should a pet fail to position itself centrally of the door 10.

Thus, whilst the pet doors according to the invention are mainly meant to distinguish owners' pets from other animals e.g. strays, there is a possibility of rendering the doors selective to a degree to reduce the likelihood of neighbours pets being able to enter each others homes to which the present pet doors are fitted.

We claim:

1. A pet door with a frame defining an access aperture and an aperture-closing flap pivotally mounted therein, wherein the pet door has latch means to bar said flap from opening in at least one direction and control means for disabling said latch means to permit said flap to open in said at least one direction, said latch means comprising a catch and a collapsible support operative normally to maintain said catch in a flap-barring position, said control means comprising magnetically-responsive actuating means cooperative with said latch means normally to prevent said support from collapsing, said magnetically-responsive actuating means having a magnet means and activatable when a magnetic key means is juxtaposed therewith, to allow said support to collapse and enable said catch to be moved from the flap-barring position to permit said flap to open in said at least one direction.

2. A pet door according to claim 1, in combination with key means, adapted to be fastened to a pet collar.

3. A pet door according to claim 1, wherein said latch means and control means including said actuating means are located within a housing in the frame, and said catch means is movable in an opening in the frame from a flap-barring position projecting into said access aperture to a retracted position permitting said flap to open in the said one direction.

4. A pet door according to claim 3, wherein a thrust exerted on the flap in said one direction is operative to displace the catch and collapse the support when the actuating means has been activated by the magnetic key means.

5. A pet door according to claim 3, wherein the control means includes two interconnected, movable mechanisms one co-operative with the support normally to prevent it collapsing and the other, comprising said actuating means, being a see-saw or rockable lever mounting a magnet, the latter lever being arranged to move the other mechanism when said magnet is repelled by said key means to move said other mechanism out of a collapse-preventing position relative to said support.

6. A pet door according to claim 3, wherein the collapsible support is a toggle-joint spring-biased against one of two adjacent abutments and maintained thereby in an erect, catch-supporting position, the second abutment being displaceable away from said toggle-joint, to allow same to collapse away from the first abutment, by activation of said magnetically-responsive actuating means.

7. A pet door according to claim 6, wherein means carrying said second abutment is mounted on a substantially frictionless pivotal mounting, said carrying means being mechanically coupled to the actuating means.

8. A pet door according to claim 7, wherein said actuating means is a rocking lever mounted on a substantially frictionless pivot, the rocking lever bearing at least one magnet to coact with said key means.

9. A pet door according to claim 8, wherein said rocking lever has said at least one magnet at one end, and at its opposite end, said lever is interconnected with said carrying means of said second abutment.

10. A pet door according to claim 9, wherein a pin-and-slot coupling interconnects said lever and carrier means.

11. A pet door according to claim 6, wherein said toggle joint has a pair of pivotally-interconnected links, one coupled to said catch and the other attached to a pivot mounting on the frame, and a spring tensioned between an attachment point on one of said links, and an anchorage on said frame biases said toggle joint toward said one abutment.

12. A pet door according to claim 1, wherein the collapsible support is spring-biased to a non-collapsed state to maintain the catch in the flap-barring position, and said control means is operable to block collapse of the collapsible support until the actuating means is activated by said magnetic key means.

13. A pet door according to claim 12, wherein a thrust exerted on the flap in said one direction is operative to displace the catch and collapse the support when the actuating means has been activated by the magnetic key means.

14. A pet door according to claim 1, wherein said actuating means is activatable to allow said support to collapse when magnetically repelled by presentation of said key means to the door.

15. A pet door according to claim 1, wherein said catch is pivotally mounted, remote from said collapsible member, on a rockable support element which mounts said catch adjacent one end, said support element being mounted to rock with said catch about an axis adjacent its other end and adjacent said collapsible member, the arrangement in use permitting said catch to be displaced out of the path of movement of said flap as said flap swings back to a closed position after being opened in said one direction.

16. A pet door according to claim 15, further including spring means biasing said catch and support element in a direction opposite that in which said catch is displaced by the swinging flap.

17. A pet door with a frame defining an access aperture and an aperture-closing flap pivotally mounted therein, wherein the pet door has latch means to bar said flap from opening in at least one direction and control means for disabling said latch means to permit said flap to open in said at least one direction, said latch means comprising a catch and a collapsible support operative normally to maintain said catch in a flap-barring position, said control means including a movable abutment cooperative with said collapsible support normally to prevent the collapsible support from collapsing and a magnetically-responsive actuating means comprising a rockable lever mounting a magnet activatable when a magnetic key means is juxtaposed therewith, said actuating means being interconnected with said movable abutment such that when said magnet is repelled by said key means said abutment is displaced out of a collapse-preventing position so that, when a thrust is exerted on the flap in said one direction, said collapsible support is collapsed and said catch is displaced allowing said flap to open.

18. A pet door according to claim 17, wherein said collapsible support is a toggle-joint spring-biased against a second abutment and maintained thereby in an erect, catch-supporting position.

19. A pet door according to claim 17, wherein said catch is pivotally mounted, remote from said collapsible support, on a rockable support element which mounts said catch adjacent one end, said support element being mounted to rock with said catch about an axis adjacent its other end and adjacent said collapsible support such that said catch is permitted to be displaced out of the path of movement of said flap as said flap swings back to a closed position after being opened in said one direction.

20. A pet door for mounting in an opening in a barrier to control pet passage beyond said barrier, comprising:

a frame, said frame defining a pet access opening therethrough;

a flap pivotally mounted to said frame for opening and closing movement with respect to said pet access opening; and locking means associated with said frame for controlling movement of said flap in at least one direction, said locking means comprising a catch pivotally mounted for movement between a flap locking position and a flap unlocking position, a support normally contactable with said catch to preclude unlocking pivotal movement of said catch, and movable to a non-catch supporting position, an abutment positioned to normally preclude movement of said support away from said catch, said abutment having permanent magnet means associated therewith, and separate magnet key means for use to magnetically influence said abutment magnet means to cause movement of said abutment away from said support means whereby upon adequate force on said flap by a pet, said catch will collapse said support and pivot away from said flap to permit said pet to pivot said flap adequate to permit said pet to move through said access opening, after which said catch return pivots to a flap locking position.

* * * * *